US005483714A

United States Patent [19]

Casassa

[11] Patent Number: 5,483,714

[45] Date of Patent: Jan. 16, 1996

[54] INFANT POST-FEEDING DEVICE

[76] Inventor: Thomas B. Casassa, 1321 Clearview Dr., Mount Juliet, Tenn. 37122

[21] Appl. No.: 243,678

[22] Filed: May 16, 1994

[51] Int. Cl.[6] ..... A47D 13/06; A47D 15/00

[52] U.S. Cl. ..... 5/655; 5/424; 1289/869; 1289/876

[58] Field of Search ..... 5/424, 655; 128/869, 128/870, 876

[56] References Cited

U.S. PATENT DOCUMENTS

| | | | |
|---|---|---|---|
| Re. 24,377 | 10/1957 | Creelman . | |
| 2,846,700 | 8/1958 | De Puy | 5/655 X |
| 3,045,258 | 7/1962 | Walsche | 5/424 |
| 3,721,434 | 3/1973 | Spies | 5/655 |
| 3,968,911 | 7/1976 | Haas | 5/424 X |
| 4,067,565 | 1/1978 | Daniels . | |
| 4,205,669 | 6/1980 | Hamann . | |
| 4,712,258 | 12/1987 | Eves | 5/424 |
| 5,014,376 | 5/1991 | Doran et al. . | |
| 5,127,120 | 7/1992 | Mason . | |
| 5,127,422 | 7/1992 | Colon . | |
| 5,161,273 | 11/1992 | Deck . | |
| 5,189,748 | 3/1993 | Garrison et al. . | |

FOREIGN PATENT DOCUMENTS

| | | |
|---|---|---|
| 1449012 | 7/1986 | France . |
| 257013 | 6/1988 | Germany . |

*Primary Examiner*—Michael F. Trettel
*Attorney, Agent, or Firm*—Sprung Horn Kramer & Woods

[57] ABSTRACT

A infant post-feeding device comprises an elongated flexible base member positionable beneath an infant's abdomen during use and having two spaced apart slots extending perpendicular to a longitudinal axis of the base member. A belt extends through the two slots and around the infant's waist during use, wherein the belt has two releasably connectable free end portions to fit the belt closely around the infant's waist. The flexible base member is sufficiently flexible to permit limited rolling while preventing rolling over.

13 Claims, 2 Drawing Sheets

INFANT POST-FEEDING DEVICE

BACKGROUND OF THE INVENTION

The present invention is directed to an infant post-feeding device, and in particular, to a device for keeping an infant on its stomach after eating.

Many devices are known for which are used to restrain an infant during surgery or other medical procedures. These known devices involve complex structures which are expensive to produce and which are adapted to extend the entire length of the infant's body.

SUMMARY OF THE INVENTION

The main object of the present invention is to eliminate the disadvantages of the prior art and to provide a device for preventing an infant from rolling over, and in particular, to keep an infant on its stomach after feeding. It is believed that keeping an infant on its stomach after feeding, aids in its digestion.

Another object of the present invention is to provide a device which prevents a baby from turning over in its crib or on the floor no matter how hard the baby may try, while allowing a limited amount of flexibility to allow the baby to roll slightly, with the baby always returning to the stomach down position.

A further object of the present invention is to provide a device which still allows a child the freedom to move, crawl or do anything else that a baby may want to do except roll over.

These and other objects and advantages of the present invention are achieved in accordance with the present invention by a device comprising an elongated flexible base member positionable beneath an infant's abdomen during use and having two spaced apart slots extending perpendicular to a longitudinal axis of the base member. A belt extends through the two slots and around the infant's waist during use, wherein the belt has two free end portions and means for releasably connecting the two free end portions to fits the belt closely around an infant's waist. The flexible base member is sufficiently flexible to permit limited rolling while preventing rolling over.

In accordance with a preferred embodiment of the present invention, the flexible base member has a length sufficient to extend beyond the sides of an infant and a width extending only along the length of the infant's abdomen. This enables the infant to crawl even when the device is fitted on the infant.

In a particularly preferred embodiment, the base member has a channel between the two slots for accommodating the belt.

In a preferred embodiment of the present invention, the belt is elastic and the base member is composed of high impact plastic, spring metal or similar flexible material.

In another preferred embodiment of the present invention, the base member has rounded edges and is preferably covered with a smooth fabric.

In still another preferred embodiment of the present invention, the base member comprises a laminate of two layers, with the belt disposed therebetween and extending out of two spaced apart slots.

In another preferred embodiment of the present invention, the elastic strap has mechanical hook and loop connectors thereon for releasably connecting the free ends thereof.

These and other features of the present invention will be disclosed in more detail in the following detailed description of the invention taken with the attached drawings, wherein:

DETAILED DESCRIPTION OF THE INVENTION

Figure 1:
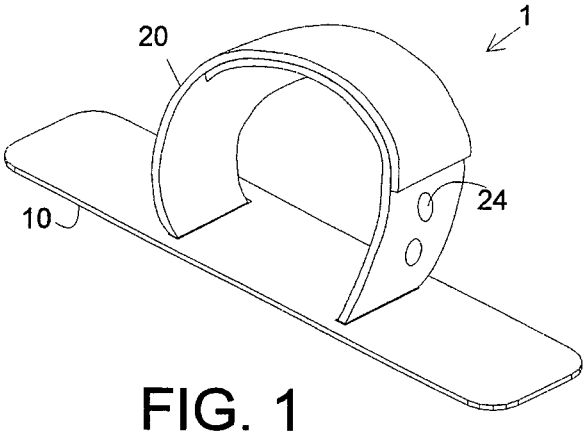
FIG. 1 is a perspective view of the device according to the present invention.
Figure 2:
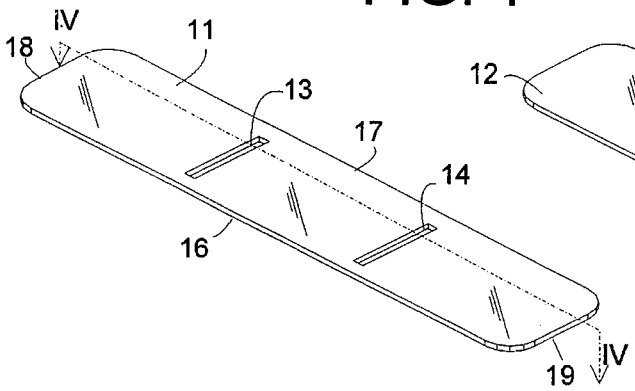
FIG. 2 shows the top of the base member of FIG. 1.

Referring now to FIGS. 1–4, an infant post-feeding device 1 for preventing an infant from rolling over and aiding in its digestion is described.

The device includes a flexible base member 10 having two slots 13 and 14 which extend perpendicular to a longitudinal axis of the base member 10. The longitudinal axis of base member 10 is parallel to edges 16 and 17 and perpendicular to edges 18 and 19.

Figure 3:
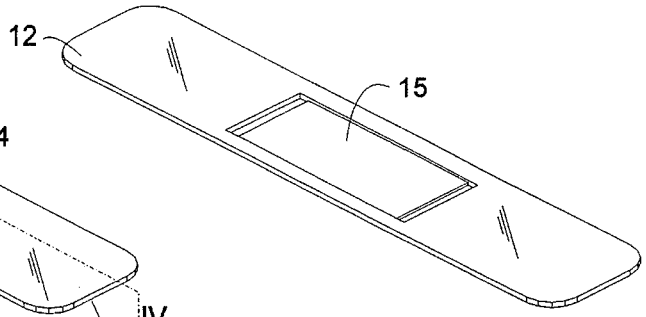
FIG. 3 shows the bottom of the base member of Fig.
Figure 4:
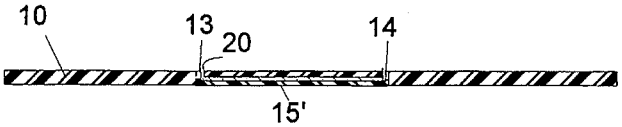
FIG. 4 is a sectional view along line IV-IV in FIG. 2.

The top surface 11 faces the abdomen of a baby or infant during use and the underside surface 12 has a channel 15 therein disposed between slots 13 and 14 for receiving the elastic belt 20. After the belt is disposed in channel 15, the channel is filled in with an epoxy resin filler material 15' which hardens to form a surface flush with surface 12 as shown in FIG. 3. Preferably the filler is the same material as the base member.

Figure 8:
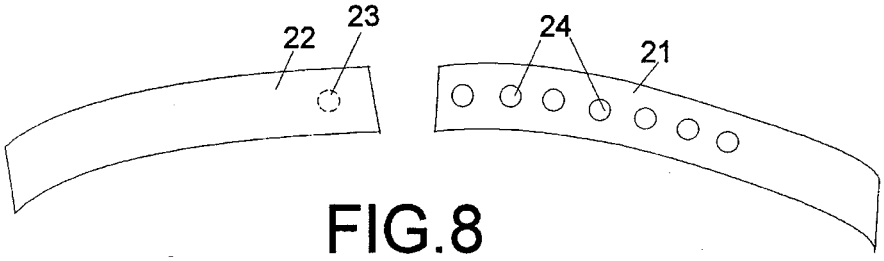
FIG. 8 shows the releasable connectors for the belt of FIG. 1.
Figure 9:
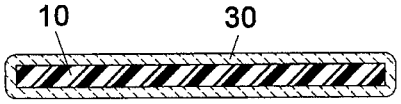
FIG. 9 is a sectional view of a still further embodiment of the present invention.
Figure 10:
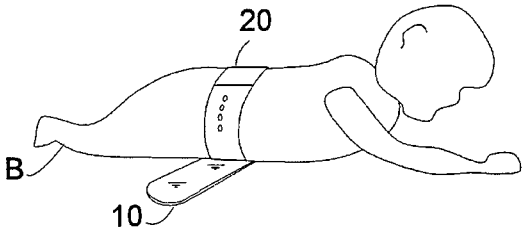
FIG. 10 shows the embodiment of FIG. 1 in use on a baby.

The elastic belt, as shown in more detail in FIG. 8, has two free ends 21 and 22. The belt is looped through the slots 13 and 14 and around the baby's abdomen as shown in FIG. 9 with the releasable connectors 23 and 24 maintaining the belt in place. The releasable connectors are preferably loop connectors 24 and hook connectors 23 sold under the trademark VELCRO. In the embodiment shown, the connectors are in the form of circular members with the hook connector 23 able to releasably connect to any one of the circular loop connectors 24.

The flexible base member 10 is preferably made of flexible material, such as, high impact polystyrene plastic, plexiglass or spring metal. The base member is preferably 15" long and 3½" wide with the slots 13 and 14 disposed approximately 5" apart. The thickness of the base member is approximately to ⅛ to ½". The elastic belt 20 preferably is 25" long and 2" wide for fitting around most infants.

Figure 6:
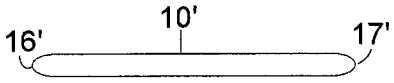
FIG. 6 shows a detail of a further embodiment of the present invention.
Figure 7:
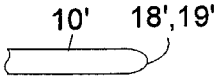
FIG. 7 is a detail of still a further embodiment of the present invention.

In an alternative embodiment of the present invention as shown in FIGS. 6 and 7, the edges 16', 17', 18', and 19' are rounded to protect the infant from injury.

In an further embodiment of the present invention as shown in FIG. 9, the base member 10 is covered by a smooth fabric 30 to prevent injury to the infant.

Figure 5:
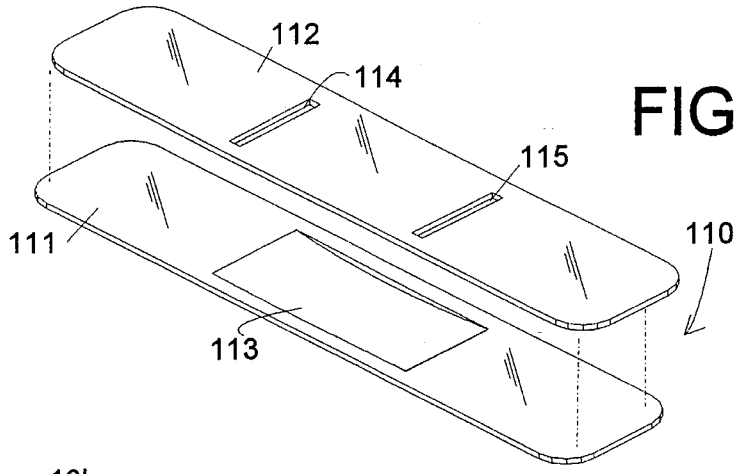
FIG. 5 shows an alternative embodiment of the present invention.

In another embodiment of the present invention shown in FIG. 5, the base member 110 is formed from a laminate of two layers 111 and 112 each about to ⅛to ¼" thick. The bottom layer 11i has a depression 113 therein for receiving the belt 20 and the top layer 112 has the slots 114 and 115 therein through which the free ends of the belt extend.

During manufacture, the belt is extended through the slots 114 and 15 and the two layers 111 and 112 are connected by an adhesive or the like.

It is understood that the embodiments described hereinabove are merely illustrative and are not intended to limit the scope of the invention. It is realized that various changes, alterations, rearrangements and modifications can be made by those skilled in the art without substantially departing from the spirit and scope of the present invention.

What is claimed is:

1. An infant post-feeding device comprising: an elongated flexible base member positionable beneath an infant's abdomen during use and having two spaced apart slots extending perpendicular to a longitudinal axis of the base member; a belt extending through the two slots and around the infant's waist during use, wherein the belt has two free end portions having means for releasably connecting the two free end portions to fit the belt closely around the infant's waist; wherein the flexible base member is sufficiently flexible to permit limited rolling while preventing rolling over.

2. The device according to claim 1, wherein the flexible base member has a length sufficient to extend beyond the sides of the infant and a width extending along the length of the infant's abdomen.

3. The device according to claim 2, wherein the base member is about 15 inches long and about 3½ inches wide.

4. The device according to claim 1, wherein the base member has one surface facing downward during use and having a channel between the two slots for accommodating the belt.

5. The device according to claim 1, further comprising a hardenable filler material filling the channel over the belt.

6. The device according to claim 1, wherein the means for releasably connecting comprises a mechanical hook and loop connector having a plurality of loop sections on one free end portion and a hook sections on the other free end portion.

7. The device according to claim 1, wherein the base member has rounded edges.

8. The device according to claim 1, wherein the base member comprises plastic.

9. The device according to claim 1, wherein the base member comprises spring metal.

10. The device according to claim 1, wherein the base member has a fabric covering thereover.

11. The device according to claim 1, wherein the base member comprises a laminate with the portion of the belt between the two slots disposed between two layers of the laminate.

12. The device according to claim 11, wherein one layer has a depression therein for receiving the belt.

13. The device according to claim 1, wherein the belt is elastic.

* * * * *